US007065968B2

(12) United States Patent
Takahashi et al.

(10) Patent No.: US 7,065,968 B2
(45) Date of Patent: Jun. 27, 2006

(54) STEAM TURBINE

(75) Inventors: Masaki Takahashi, Hitachi (JP); Yoshifumi Kubo, Takahagi (JP); Akitaka Tateishi, Hitachinaka (JP); Katsutoshi Higuma, Takahagi (JP); Akio Umino, Hitachi (JP); Yasuhiro Oda, Utsunomiya (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/957,710

(22) Filed: Oct. 5, 2004

(65) Prior Publication Data

US 2005/0072157 A1 Apr. 7, 2005

(30) Foreign Application Priority Data

Oct. 6, 2003 (JP) ..... 2003-346477

(51) Int. Cl.
*F01K 1/00* (2006.01)

(52) U.S. Cl. ..... 60/670; 415/200

(58) Field of Classification Search ..... 60/670; 415/200, 214.1, 215.1
See application file for complete search history.

(56) References Cited

U.S. PATENT DOCUMENTS 3,677,658 A * 7/1972 Dinenno et al. ..... 415/108
4,940,383 A * 7/1990 Silvestri, Jr. ..... 415/44
6,302,644 B1 * 10/2001 Kukalj et al. ..... 415/155

FOREIGN PATENT DOCUMENTS

JP 60-159310 1/1984

* cited by examiner

*Primary Examiner*—Hoang Nguyen
(74) *Attorney, Agent, or Firm*—Mattingly, Stanger, Malur & Brundidge, P.C.

(57) ABSTRACT

In a steam turbine plant in which a turbine casing containing a turbine is constituted of an upper-half casing and a lower-half casing, nozzles are provided to the upper-half casing and a steam supplied through main steam piping lines are deliveried into the upper-half casing. Main steam pipes for supplying a steam from respective main valves to the respective nozzles are each formed so as to be dividable in a position out of the installation area of the upper-half casing.

6 Claims, 6 Drawing Sheets

STEAM TURBINE

BACKGROUND OF THE INVENTION

1. Field of the Invention

The present invention relates to a steam turbine plant.

2. Description of the Related Art

Conventional steam turbine plants include one disclosed in JP, A 60-159310, for example. JP, A 60-159310 discloses a steam turbine having a dual casing structure composed of an inner and an outer casing wherein the space between the inner and outer casings is divided by a partition wall into a first steam passage allowing part of main steam to pass along the outer surface of the inner casing and a second steam passage allowing cooling steam to pass along the inner surface of the outer casing, and wherein an opening/closing device is provided to each of the first and second steam passages, whereby thermal stress in the inner and outer casings is reduced even if this steam turbine is frequently started and stopped. JP, A 60-159310 further discloses a structure wherein main steam piping line for supplying a steam from a boiler is connected to an upper portion of the outer casing, and wherein an exhaust hole is provided for discharging exhaust steam that has worked at various stages of the turbine and sending it to a next turbine.

SUMMARY OF THE INVENTION

Generally, in order to facilitate the removal of the upper-half casing when performing maintenance of a steam turbine, the main steam piping line for supplying a main steam from steam generating equipment such as boiler equipment to the steam turbine is configured to be connected to a lower-half casing. As a result, the steam turbine requires a space below it for installing pipes of the main steam piping line having a large bore size. This increases the installation height of the turbine, resulting in a high-rise of the turbine building.

On the other hand, as in the above-described JP, A 60-159310, in the case where main steam piping line connected to the turbine casing is configured to be connected to an upper portion of the turbine casing, when attempting to disconnecting and conveying the turbine casing upon maintenance, the main steam piping line connected to the upper portion of the turbine casing unfavorably interferes with the disconnecting and conveying of the turbine casing, thereby making the maintenance operation troublesome.

It is an object of the present invention to provide a steam turbine plant which allows the setting level of the steam turbine to be lowered and enables the maintenance of the steam turbine to be facilitated.

To achieve the above-mentioned object, the present invention provides a steam turbine plant in which a turbine casing containing a turbine is constituted of an upper-half casing and a lower-half casing, the steam turbine plant comprising a main steam piping line, and a nozzle provided to the upper-half casing and through which a steam supplied through the main steam piping line is delivered into the upper-half casing, wherein the main steam piping line includes a main steam pipe for supplying a steam from a main valve to the nozzle and the main steam pipe is formed so as to be dividable in a position out of an installation area of the upper-half casing.

According to the present invention, a steam turbine plant can be provided that allows the setting level of the steam turbine to be lowered and enables the maintenance of the steam turbine to be facilitated.

DESCRIPTION OF THE PREFERRED EMBODIMENTS

Hereinafter, preferred embodiments of the present invention will be described with reference to the accompanying drawings.

First Embodiment

Figure 3:
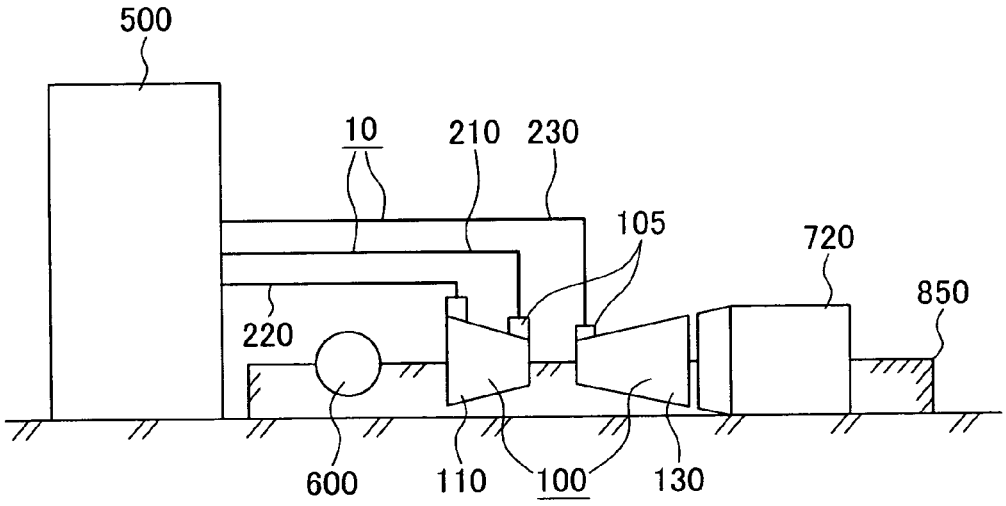
FIG. 3 is an overall schematic plan view of a steam turbine plant according to the first embodiment.

FIG. 3 is a schematic view of a steam turbine plant according to a first embodiment of the present invention. The steam turbine plant according to this embodiment comprises steam turbines 100 driven by steam, boiler equipment 500 for generating drive steam, a power generator 600 driven with rotation of the steam turbine 100, main steam piping lines 10 for supplying steam generated by the boiler equipment 500 to the turbines 100, and an axial flow condenser 720 disposed in an axial direction of the steam turbines 100 for condensing a steam discharged from the steam turbines 100. The steam turbines 100 and the power generator 600 are installed on a steam turbine mount surface 850. The steam turbines 100 includes a high-pressure steam turbine 110 and a middle-pressure steam turbine 130. The main steam piping lines 10 comprise a high-pressure main steam piping line 210 for introducing a high-pressure steam generated by the boiler equipment 500 to the high-pressure steam turbine 110, and a middle-pressure main steam piping line 230 (high-temperature reheat steam piping line) for introducing a middle-pressure steam to the middle-pressure steam turbine 130, the middle-pressure steam being obtained by reheating an exhaust gas returned from the high-pressure steam turbine 110 by a reheater (not shown) in the boiler 500. The exhaust gas from the high-pressure steam turbine 110 is returned to the boiler equipment 500 through a low temperature reheat steam piping line 220. Also, the steam turbines 100 to which the main steam piping lines 10 are connected, comprise nozzles 105 at steam inlets of turbine casings to be described later.

Figure 1:
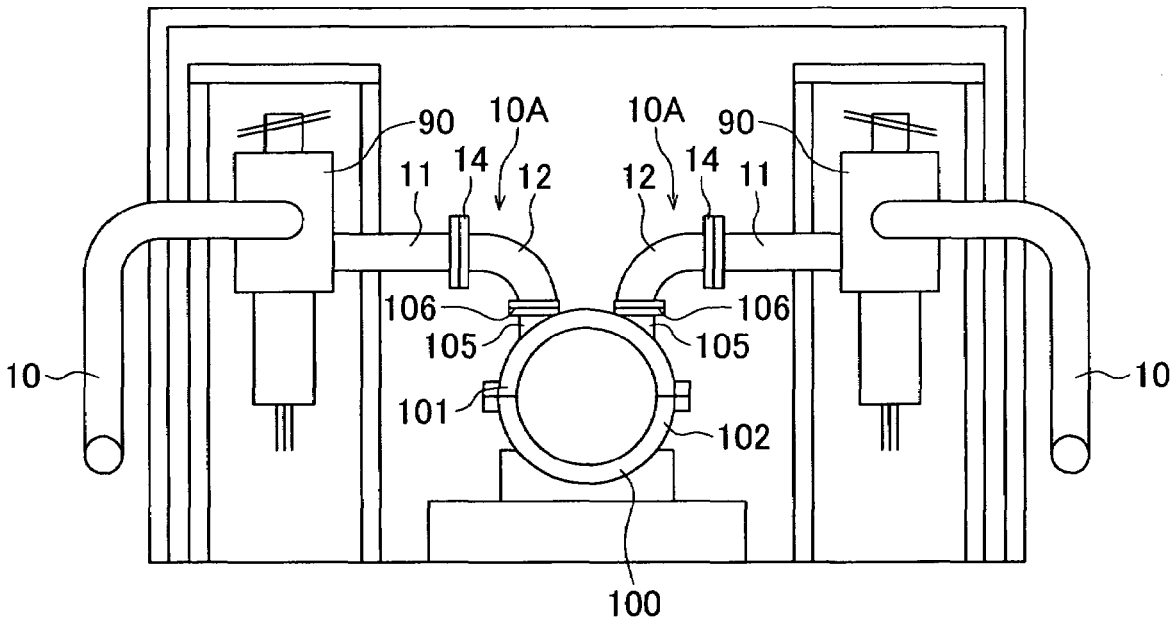
FIG. 1 is a view (sectional view) showing a structure of a first embodiment of the present invention in which main steam pipes are each connected to an upper-half casing of a steam turbine, according to a first embodiment of the present invention.

FIG. 1 is a sectional view of the steam turbine plant according to this embodiment as seen in a turbine axial direction. High-pressure steam and middle-pressure steam (reheat steam) generated by the above-described boiler equipment 500 are supplied to the steam turbine 100 through the main steam piping lines 10 (high-pressure steam piping lines 210 and middle-pressure steam piping lines (high-temperature reheat piping lines) 230), main valves 90 such as main steam adjusting valves and stop valves. The main steam piping lines 10 each comprises a main steam pipe 10A for introducing steam from the main valve to the steam turbine 100, and the main steam pipe 10A comprises a first main steam pipe (hereinafter, a main steam pipe 11) and a second main steam pipe (hereinafter, a short pipe 12). A steam having past through the main steam pipe 11 and the short pipe 12 is supplied to the steam turbine 100 through the nozzle 105 provided to the upper-half casing 101 of the steam turbine 100. The connection portion between the main steam pipe 11 and the short pipe 12 and the connection portion between the short pipe 12 and the nozzle 105 are provided with flanges, respectively. Specifically, a main steam pipe flange 14 is formed in the connection portion between the main steam pipe 11 and the short pipe 12, while a main steam pipe nozzle portion flange 106 is formed in the connection portion between the short pipe 12 and the nozzle 105. In the example illustrated in FIG. 1, the short pipes 12 are connected to the casing via the respective flanges 106, but they may instead be formed integrally with the casing. The casing of the steam turbine 100 comprises an upper-half casing 101 and a lower-half casing 102. The nozzles 105, each serving as a steam inlet of the steam turbine 100, are installed to the upper-half casing 101 of the steam turbine 100. By virtue of this configuration, as shown in FIG. 3, the main steam piping lines 10 can be run in higher places than the axial center line of the steam turbines 100. This eliminates restriction by the main steam piping lines with respect to the installation height of the steam turbine 100, thereby allowing the steam turbine 100 itself to be installed at a lower place.

Figure 4:
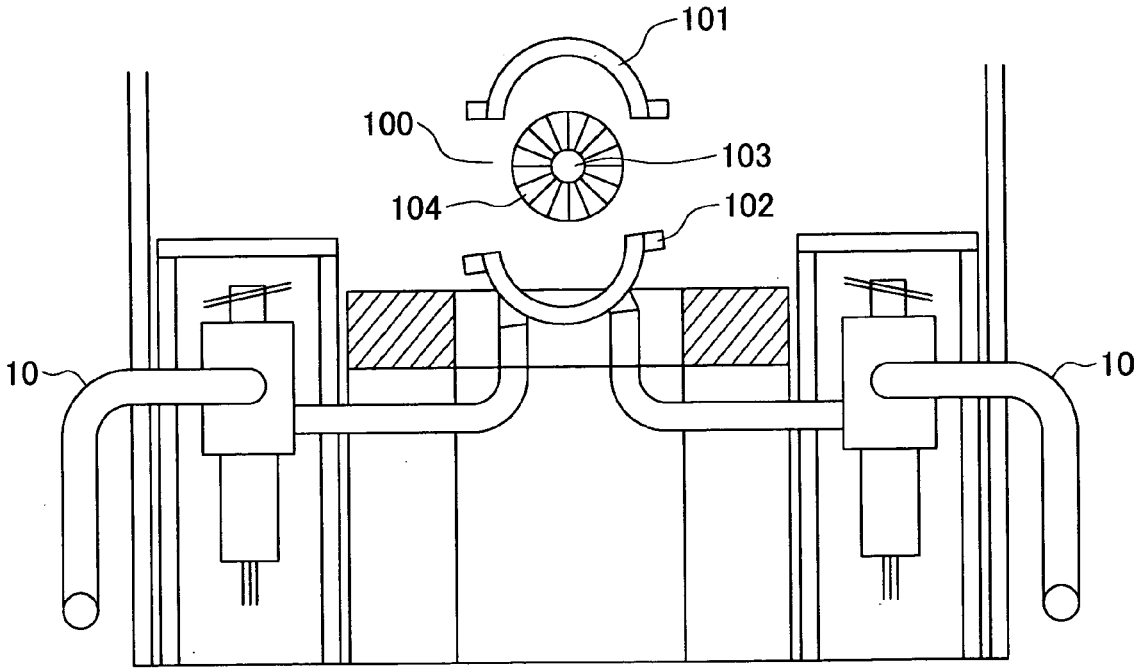
FIG. 4 is a view showing a state where the steam turbine casing has moved due to thermal expansion.

Meanwhile, the main steam piping lines 10 generate thermal expansion and contraction due to the temperature difference between a plant operation time and a plant stop time, thereby generating reaction force moments with respect to the boiler equipment 500 and the steam turbine 100 which are fixedly mounted. As shown in FIG. 4, even when the main steam piping lines 10 are connected to the lower-half casing 102 from below the steam turbine 100, the position of the steam turbine 100 is not changed by the above-described reaction forces, because the reaction forces are usually held down by the weights of the lower-half casing 102, a turbine rotor 103, a turbine blade 104, and the upper-half casing 101. However, when the plant is adjusted and installed under the condition where the piping lines have been thermally expanded, for the purpose of preventing the piping lines from being subjected to a reaction force during operation, an inverse reaction force occurs at an operation stop time due to the contraction of the main steam piping lines 10. As a result, when the upper-half casing 101, turbine rotor 103, turbine blade 104, etc. are removed during maintenance or the like, the overall weight of the steam turbine 100 reduces, and therefore, the lower-half casing 102, which is left unremoved, may unfavorably moves during the maintenance or the like, due to thermal contraction of the main steam piping lines 10.

On the other hand, in this embodiment, the main steam piping lines for supplying a steam to the steam turbine 100 is connected to the upper-half casing 101, and further the short pipes 12 can be removed during maintenance. Therefore, even when the disconnection of the upper-half casing 101, turbine rotor 103, turbine blade 104 and the like during maintenance reduces the weight over the lower-half casing 102, the lower-half casing 102 is not subject to thermal expansion and the like of the main steam piping lines, thereby eliminating the occurrence of movement of the lower-half casing 102. In other words, as shown in FIG. 1, when the main steam piping lines 10 are each connected to the upper-half casing 101 from above, the main steam piping lines 10 are perfectly separated from the lower-half casing 102 during maintenance, thereby preventing thermal expansion and contraction of the main steam piping lines 10 (main steam pipe 11) from transmitting to the lower-half casing 102.

Figure 2:
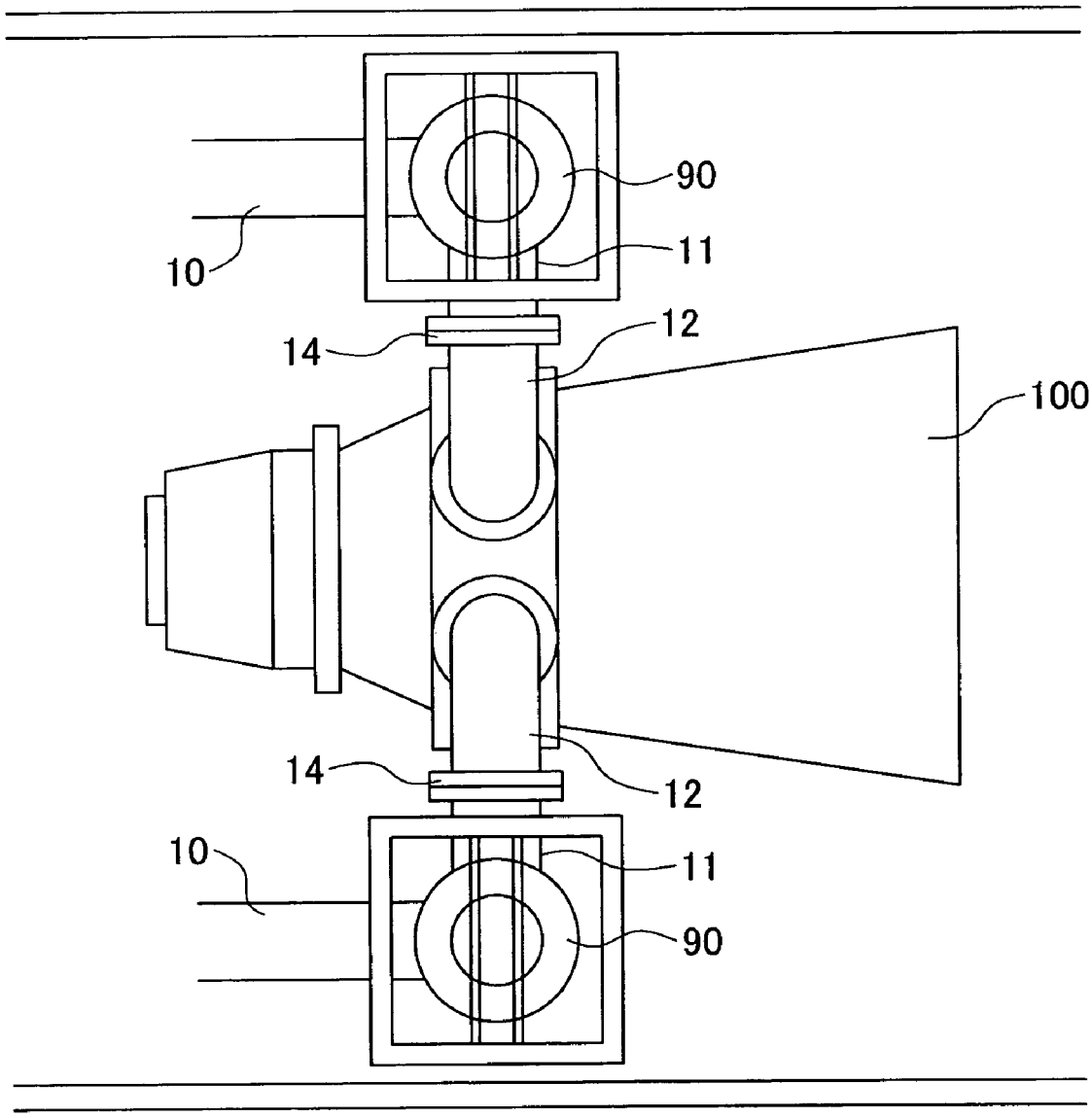
FIG. 2 is a view (plan view) showing a structure in which the main steam pipes are each connected to the upper-half casing according to the first embodiment.

In the conventional art, in which the main steam piping lines 10 are each connected to the lower-half casing 102 as shown in FIG. 4, the removal of the upper-half casing 101 can be easily performed during maintenance since pipes and the like are not connected to the upper-half casing 102. However, as shown in FIG. 1, when the main steam piping lines 10 are each connected to the upper-half casing 101, it is necessary to separate the main steam piping lines 10 from the upper-half casing 101 in order to disconnect the upper-half casing 101. For this purpose, in this embodiment, there are provided the flanges (a main steam pipe flange 14 and a main steam pipe nozzle portion flange 106) for separating the main steam pipe 10A from the upper-half casing 101. In particular, the main steam pipe flange is disposed between the nozzle 105 and the main valve 90 in a position out of the installation area of the upper-half casing 101 as viewed in a horizontal plane as shown in FIG. 2.

When the upper-half casing 101 of the steam turbine 100 is to be conveyed after having been disassembled, the upper-half casing 101 is first moved in a vertically upward direction, and then conveyed in the other direction from the position where no interfering object has come to be found therearound. Therefore, when the upper-half casing 101 is to be conveyed in the vertically upward direction, it is desirable that the main steam pipes 11 and the main valves 90 disconnected from the upper-half casing 101 do not interfere therewith. For this purpose, as shown in FIG. 2, the main steam pipe flanges 14 for separating the main steam pipes 11 from the upper-half casing 101 are each located in a position having a wider width than expected to cause interference with the upper-half casing 101 upon conveyance thereof in the vertically upward direction. By providing the flanges 14 in such positions and separating the short pipes 12 from the main steam pipes 11 at the flanges 14 upon maintenance, it is possible to eliminate any obstacles above the upper-half casing 101, and easily perform disconnection work and conveyance operation.

Furthermore, in this embodiment, there are provided the main steam pipe nozzle portion flanges 106. When the main steam pipe flanges 14 are each disposed far apart from the nozzle 105, the short pipes 12 have to become correspondingly longer, thereby unfavorably increasing their weights. Therefore, when the upper-half casing 101 is conveyed with the short pipes 12 connected therewith, the weights to be conveyed become heavier, resulting in inconvenience for conveyance operation. In addition, there occurs the need for a wide range of space for placing the upper-half casing 101 after conveyance. In contrast, in this embodiment, when the upper-half casing 101 is disconnected and conveyed, the short pipes 12 are removed from the main steam pipe nozzle portion flanges 106, thereby facilitating the conveyance of the upper-half casing 101. The length of the short pipe 12 should be designed to be a length such that the main valve 90 takes a position that does not interfere with the upper-half casing 101 when the upper-half casing 101 is disconnected and conveyed.

The steam turbine 100 with the above-described structure may also be applied to a conventional high-floor power generation plant. Moreover, this steam turbine 100 can be applied to a low-floor power generation plant that has been difficult to realize when the main steam piping lines 10 are connected to the lower-half casing 102 as in the conventional steam turbine 100.

In this way, the high-pressure and middle-pressure or reheat main steam piping lines 10 that have conventionally been connected to the lower-half casing 102, are connected to the upper-half casing 101 as shown in FIG. 1, and further, as shown in FIG. 2, the main valves 90 for the main steam piping lines 10 are disposed in proper positions such as not to interfere with the disconnection/conveyance of the upper-half casing 101 upon maintenance of the steam turbine 100, that is, in the positions wider than that of the upper-half casing 101 of the steam turbine 100. Specifically, the main steam pipes 10A are each formed so as to be dividable in a position out of the installation area of the upper-half casing 101 as viewed in a horizontal plane as shown in FIG. 2. In other words, the flanges 14 are each formed as dividing means in a way of the main steam pipe 10A connecting the main valve 90 and the nozzle 105, and these flanges 14 are each located in a position out of the installation area of the upper-half casing 101 as viewed in a horizontal plane as shown in FIG. 2. Also, as shown in FIG. 1, in order that the main steam pipes 10A (short pipes 12) become separable from the upper-half casing 101 of the steam turbine 100, the main steam pipe nozzle portion flanges 106 are each provided in a position where the main steam pipes 10A (short pipes 12) are connected to the nozzles 105 of the upper-half casing 101. With those structures, it is possible to lower the setting level of the steam turbine and to facilitate the maintenance of the steam turbine.

Second Embodiment

Figure 5:
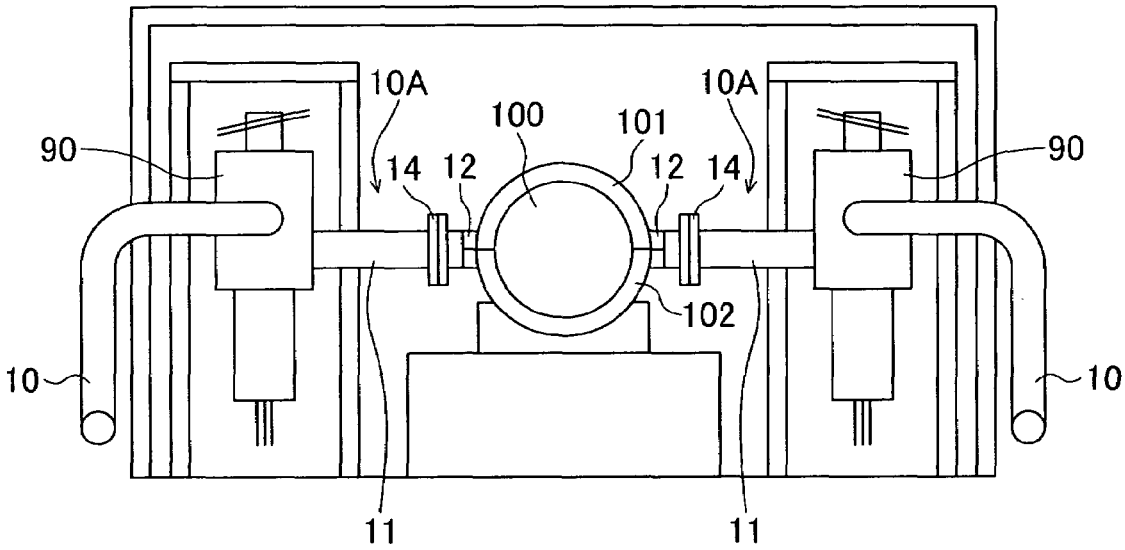
FIG. 5 is a view showing a structure of a second embodiment of the present invention in which the main steam pipes are each connected between the upper-half and lower-half casings.
Figure 6:
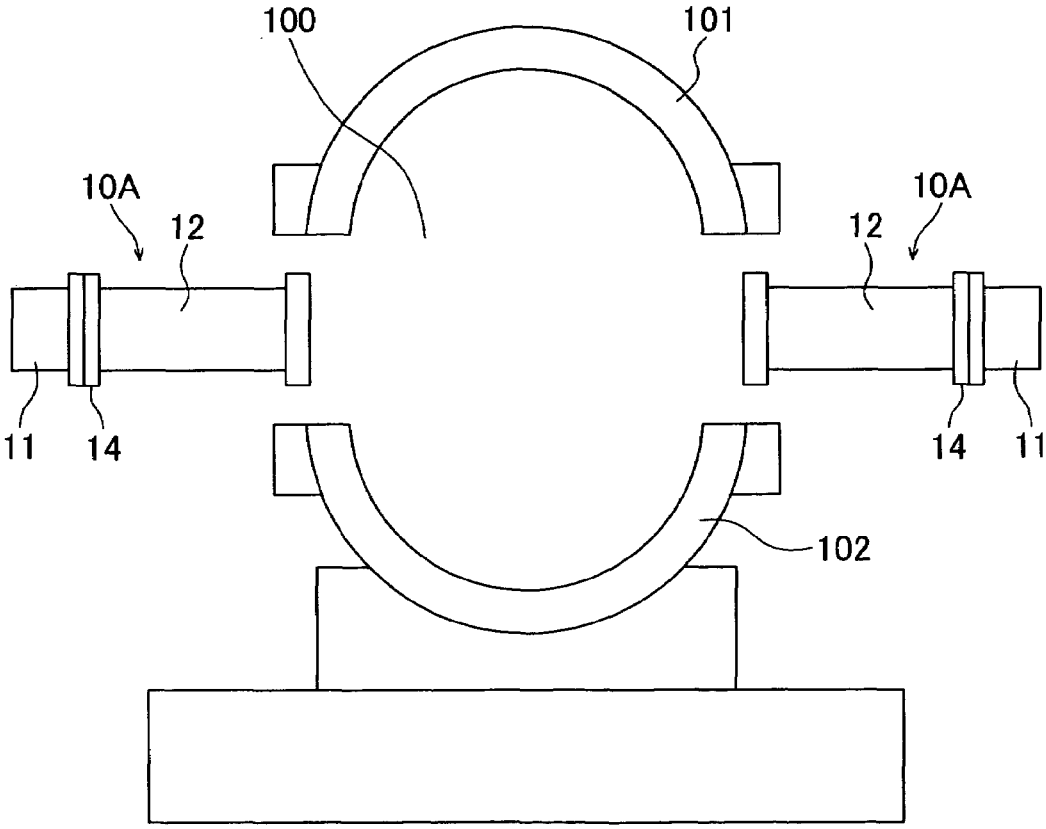
FIG. 6 is a view showing a structure in which the main steam pipes are each sandwiched between the upper-half and lower-half casings according to a modulation of the second embodiment.

FIG. 5 is a sectional view of the steam turbine plant according to a second embodiment as viewed in a turbine axial direction. As illustrated in FIG. 5, the connection portion between the steam turbine 100 and each of the main steam pipes 10A described with reference to FIG. 1 may be connected to the junction between the upper-half casing 101 and the lower-half casing 102, as shown in FIG. 5. One method for establishing such connection is to sandwich each of the main steam pipes 10A between the upper-half and lower-half casings, as shown in FIG. 6. In this case, also, just as in the case of the foregoing, the main valves 90 each needs to be disposed in a position such as not to interfere with the disconnection/conveyance of the upper-half casing 101 of the steam turbine 100, but it is foreseen that each of the main valves 90 would not interfere with the upper-half casing 101 or the interference would be small should it occur even when the main valves are disposed closest to the steam turbine 100. As a result, it can be expected that the short pipe 12 between each of the main steam pipe 11 and the steam turbine 100 can be omitted. Also, in this structure, in which the main steam pipes 10A are each sandwiched between the upper-half casing 101 and the lower-half casing 102 of the steam turbine 100, the disconnection of the upper-half casing 101 of the steam turbine 100 is implementable without separating the main steam pipes 10A from the upper-half casing 101 by the flanges 14 or the like. However, in the state where the main steam pipes 10A remain connected to the lower-half casing 102 of the steam turbine 100, there is a possibility that the lower-half casing 102 move due to reaction forces caused by thermal expansion and contraction of the main steam pipes 10A upon operation and stoppage of the steam turbine 100. When there is apprehension about such a movement of the lower-half casing 102, it is desirable that the steam turbine 100 is connected with the main steam pipes 11 through the short pipes 12 as described above. By separating the short pipes 12 from the main steam pipes 11 and the lower-half casing 102 after the upper-half casing 101 of the steam turbine 100 is disassembled and conveyed, it is possible to eliminate influences of reaction forces with respect to the lower-half casing 102 that would be otherwise caused by thermal expansion and contraction.

Figure 7:
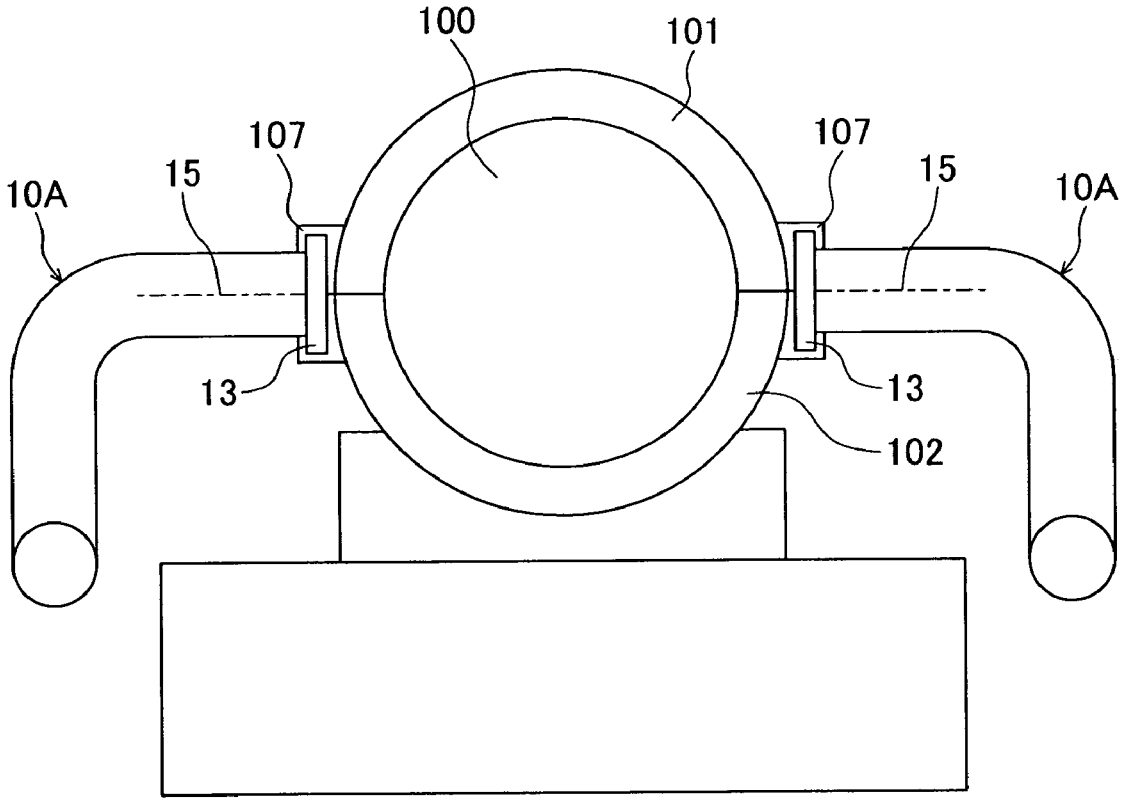
FIG. 7 is a view showing a structure of grooves and main steam pipe flanges at the connection portions between the upper-half and lower-half casings and the main steam pipes according to another modulation of the second embodiment.

Also, when the main steam pipes 10A are each connected to the casings of the steam turbine 100 by sandwiching them between the upper-half casing 101 and the lower-half casings 102 of the steam turbine 100 as described above, an end portion of each of the main steam pipes 10A is formed with a flange structure 13 as shown in FIG. 7, and each of the main steam pipe connecting portions of the upper-half casing 101 and the lower-half casing 102 is formed with a groove structure 107 into which the above-described end portion of each of the main steam pipes 10A just fits, whereby each of the main steam pipes 10A can be rotated about a pipe axis 15 even in the state of being connected to the casings of the steam turbine 100.

Figure 8:
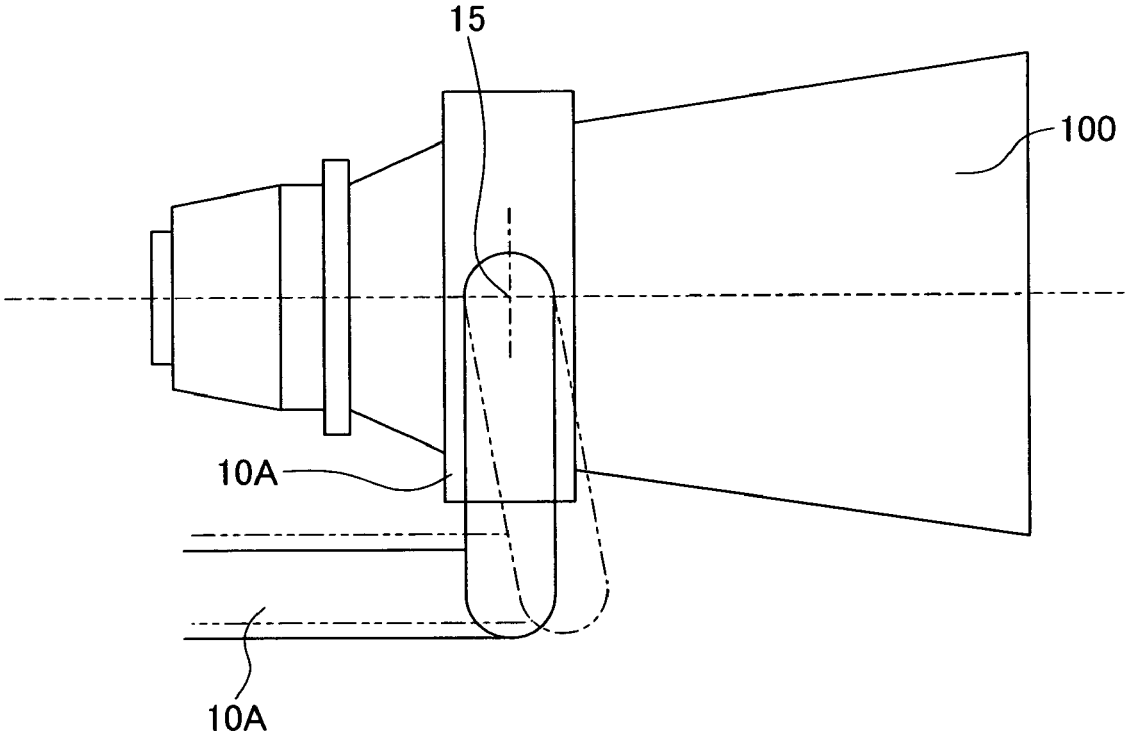
FIG. 8 is a view showing a structure for absorbing thermal expansion.

Here, each of the main steam pipes 10A is installed to extend in a route such that it is bent in the direction perpendicular to the central axis of the steam turbine 100 and the central axis of each of the main steam pipes 10A exiting the steam turbine 100, and thereafter again each of them is bent in the axial direction of the steam turbine 100, whereby a reaction force due to thermal expansion and contraction of the main steam piping lines 10 upon operation and stoppage of the steam turbine 100 is not applied thereto. This allows, as shown in FIG. 8, the amount of thermal expansion to be absorbed by rotation of the connection portion between the main steam pipe 10A and the steam turbine 100 even if the main steam piping lines 10 are subjected to thermal expansion in the axial direction of the steam turbine 100 upon operation of the steam turbine 100.

By singly adopting one of the structures described above, or combining some of these structures, it is possible to lower the installation height of the steam turbine. This allows a turbine building to be designed to be low, or enables an outdoor installation method without a turbine building to be applied. In particular, when a steam turbine with a low height is installed outdoors without a turbine building, a small-sized crane requiring no access to a high position can be used as a crane for hoisting the upper-half casing, turbine rotor, and the like upon maintenance of the steam turbine. This makes a required maintenance space smaller, and also allows safe and economical maintenance to be implemented. Moreover, this eliminates the need to support reaction forces due to heat transfer by the lower-half casing of the steam turbine and a foundation of the steam turbine when the steam turbine casing is removed, thereby reducing the possibility of accidents. Furthermore, the capability of making the turbine foundation low enables an economical power generation plant that reduces the cost of civil engineering to be constructed.

What is claimed is:

1. A steam turbine plant in which a turbine casing containing a turbine is constituted of an upper-half casing and a lower-half casing, the steam turbine plant comprising:

a plurality of main steam piping lines; and a plurality of nozzles provided only to the upper-half casing and through which steam supplied through said plurality of main steam piping lines is delivered into the turbine casing;

wherein each of said plurality of main steam piping lines includes a main steam pipe for supplying steam from a main valve to the corresponding one of said nozzles, and the main steam pipes of said plurality of main steam piping lines are all formed so as to be dividable in a position out of an installation area of the upper-half casing.

2. A steam turbine plant in which a turbine casing containing a turbine is constituted of an upper-half casing and a lower-half casing, the steam turbine plant comprising:

a plurality of main steam piping lines; and a plurality of nozzles provided only to the upper-half casing and through which steam supplied through said plurality of main steam piping lines is delivered into the turbine casing;

wherein each of said plurality of main steam piping lines includes a flange of a main steam pipe that connects a main valve and the corresponding one of said nozzles, and the flanges of said main steam pipes of said plurality of main steam piping lines are all formed in a position out of an installation area of the upper-half casing.

3. A steam turbine plant in which a turbine casing containing a turbine is constituted of an upper-half casing and a lower-half casing, the steam turbine plant comprising:

a plurality of main steam piping lines; and a plurality of nozzles provided only to the upper-half casing as steam inlets thereof;

wherein each of said plurality of main steam piping lines includes a main steam pipe having an end connected with a main valve, a flange formed at the other end of said main steam pipe, and a pipe connecting said flange and the corresponding one of said nozzles, the flanges of said plurality of main steam piping lines being all located in a position out of an installation area of the upper-half casing.

4. A steam turbine plant in which a turbine casing containing a turbine is constituted of an upper-half casing and a lower-half casing, the steam turbine plant comprising:

a main steam piping line; and a junction between the upper-half casing and the lower-half casing;

wherein said main steam piping line includes a main steam pipe connected with said junction for supplying steam from a main valve to the turbine casing and said main steam pipe is formed so as to be dividable in a position out of an installation area of the upper-half casing and the lower-half casing.

5. The steam turbine plant according to claim 4, wherein said main steam pipe is connected with said junction by being sandwiched between the upper-half casing and the lower-half casing.

6. The steam turbine plant according to claim 4, wherein said main steam pipe connected to the turbine casing is formed so as to be rotatable in the connection portion with the turbine casing.

* * * * *